United States Patent [19]

Ober et al.

[11] Patent Number: 4,613,559

[45] Date of Patent: Sep. 23, 1986

[54] PROCESS FOR COLORED TONER COMPOSITIONS WITH CONTROLLED CHARGES THEREON

[75] Inventors: Christopher K. Ober, Oakville; Kar P. Lok, Mississauga; Michael L. Hair, Oakville; Randolph E. Branston, Mississauga, all of Canada

[73] Assignee: Xerox Corporation, Stamford, Conn.

[21] Appl. No.: 718,675

[22] Filed: Apr. 1, 1985

[51] Int. Cl.[4] ..... G03G 9/08

[52] U.S. Cl. ..... 430/137; 430/106

[58] Field of Search ..... 430/137, 106

[56] References Cited

U.S. PATENT DOCUMENTS

| | | | |
|---|---|---|---|
| 3,591,537 | 7/1971 | Squire et al. | 260/17 |
| 3,767,603 | 10/1973 | Kayanagi et al. | 260/17 A |
| 3,770,692 | 11/1973 | Miller | 260/41 C |
| 3,941,729 | 3/1976 | Klein | 260/17 A |
| 3,959,153 | 5/1976 | Sadamatsu et al. | 252/62.1 P |
| 4,077,804 | 3/1978 | Vanzo | 96/1 SD |
| 4,134,760 | 1/1979 | Gibson et al. | 96/1 SD |
| 4,152,279 | 5/1979 | Mincer et al. | 252/62.1 P |
| 4,282,304 | 8/1981 | Bayley | 430/137 |
| 4,299,903 | 11/1981 | AuClair et al. | 430/137 |
| 4,448,871 | 5/1984 | Tamaki et al. | 430/109 |

FOREIGN PATENT DOCUMENTS 0010986 5/1980 European Pat. Off. .

7168254 10/1982 Japan .

OTHER PUBLICATIONS

"Kinetics of Polymerization in Dispersed Systems", Levy et al., Impac Macro, 1982, p. 76.

"Monodisperse Polymeric Spheres in the Micron Size Range by a Single Step Process", Almog et al., The British Polymer Journal, Dec. 1982, pp. 131-136.

"Polyelectrolyte Stabilised Latices Part 1, Preparation", Corner, Elsevier Scientific Publishing Company, 1981, pp. 119-129.

"Absorption of Low Molecular Weight Compounds in Aqueous Dispersions by Polymer-Oligmer Particles", 2 ed, Makromol Chem., 180, 1979, pp. 737-744.

*Primary Examiner*—John D. Welsh

*Attorney, Agent, or Firm*—E. O. Palazzo

[57] ABSTRACT

An improved process for obtaining colored toner compositions by dispersion polymerization which comprises providing a monomer solution with stabilizer therein, polymerizing the resulting mixture, adding thereto a dye solution comprised of an organic solvent having dissolved therein oil soluble dyes, causing the dye solution to diffuse into the polymer particles, and subsequently separating the resulting toner particles, wherein the stabilizer is permanently attached to the toner polymer particles.

22 Claims, No Drawings

PROCESS FOR COLORED TONER COMPOSITIONS WITH CONTROLLED CHARGES THEREON

BACKGROUND OF THE INVENTION

This invention is generally directed to processes for affecting the preparation of colored toner compositions, and more specifically the present invention is directed to processes for affecting the preparation of colored toner compositions of a negative or positive polarity by dispersion polymerization. In one embodiment of the present invention the colored toner particles are generated by the dispersion polymerization of a mixture of monomer and attached steric stabilizer, and thereafter diffusing a dye solution into the polymerized product. Subsequently, dry, colored, xerographic toners are isolated by, for example, spray drying or freeze drying of the resulting dispersions. The triboelectric properties of the toners obtained in accordance with the aforementioned process are controlled by the steric stabilizer anchored on the surface thereof. Therefore, strongly positive charging colored toners are obtained when stabilizers such as poly(vinylpyridine), poly(ethyleneoxide), and cellulosic derivatives are selected; while negatively charged colored toners are generated with steric stabilizers such as poly(acrylic acid), poly(styrene sulfonic acid), copolymers thereof, and poly(maleic anhydride) copolymers. Additionally, the stabilizers selected inclusive of hydroxypropyl cellulose can be reacted with other compounds for the purpose of transforming the surface sites thereby permitting modification of the charge on the toner composition. The resulting transformed stabilizers are thus functioning in a manner similar to known charge enhancing additives. Toner compositions obtained in accordance with the process of the present invention are useful for causing the development of images in electrostatographic imaging methods, particularly colored electrostatic imaging methods wherein the imaging members selected can be positively or negatively charged.

Polymerization processes for obtaining black toner compositions are well known. There is thus disclosed in U.S. Pat. No. 4,282,304 a suspension polymerization method wherein magnetic particles are initially mixed with monomer together with an initiator, and subsequently this mixture is suspended in an aqueous medium wherein a reaction occurs within each particle resulting in the formation of particles of the size needed for use as toner compositions. The particles obtained are removed from the aqueous medium by various known techniques inclusive of evaporation. Stabilizing compounds selected for the process of this patent include methyl hydroxypropyl cellulose, and other similar materials; however, these stabilizers are not believed to be permanently attached to the polymer product resulting.

There is also disclosed in copending application Ser. No. 553,598, entitled Ink Jet Compositions and Processes for Preparation, the disclosure of which is totally incorporated herein by reference, microsuspension processes for the preparation of particles for ink jet printing which comprises providing a monomer having dissolved therein an oil soluble dye followed by mixing with the resulting monomer particles polymer initiator compounds. Thereafter, the solution generated is mechanically mixed and there is added thereto water and surfactant agents followed by subjecting the solution resulting to ultrasound vibrations. Subsequently, the aforementioned solution is heated to a temperature of about 50° C. to about 100° C. causing polymerization, enabling polymer particles containing therein oil soluble dyes stabilized by surfactant particles; and wherein these particles are of a diameter of from about 0.03 micron to about 2.0 microns.

Moreover, described in a copending application Ser. No. 549,933, entitled Stable Polymeric Dispersion and Methods for Making, the disclosure of this application being totally incorporated herein by reference, are stable polar dispersions with non-ionic amphipathic steric stabilizers irreversibly anchored to a monomer compound. Stabilizers disclosed in this application include graft copolymers of cellulose compounds such as hydroxyethyl cellulose.

Additionally, positively charged toner compositions are known, reference for example U.S. Pat. No. 3,893,935, which discloses the use of certain quaternary ammonium salts as charge control agents for electrostatic toner compositions. Furthermore, there is disclosed in U.S. Pat. No. 4,338,390 positively charged developer and toner compositions prepared by melt blending and having incorporated therein as charge enhancing additives organic sulfate and sulfonate compounds. Similarly, disclosed in U.S. Pat. No. 4,298,672 are positively charged toner compositions comprised of resin particles, and pigment particles; and as charge enhancing additives, alkylpyridinium compounds and their hydrates. Other prior art disclosing toner compositions with charge control additives therein include U.S. Pat. Nos. 3,944,493; 4,007.293; 4,079,014; and 4,394,430.

An important disadvantage associated with conventional methods of preparing toner compositions, inclusive of melt blending, is that the charge directing additive is introduced into the toner resin during processing with the pigment particles undesirably causing most of the additive to be entrained in the core of the toner particle. Accordingly, the entrapped additives, unless present in excessive amounts, cannot substantially influence the charging properties of the resulting toner particles. Also, with many prior art processes toner particles with a diameter of below about 10 microns cannot readily be generated without effecting the removal of large quantities of fines. Additionally, in the prior art toner processing inhomogeneities in the pigment dispersion can sometimes occur during the melt blending operation resulting in opacity when, for example, such a toner is selected for the preparation of transparencies. The dispersion polymerization process of the present invention substantially eliminates these difficulties.

There is thus a need for generating colored toner compositions by dispersion polymerization processes. More specifically, there remains a need for generating colored toner compositions of selected polarities, that is, either a positive polarity or a negative polarity with dispersion polymerization processes by affecting a chemical attachment of the stabilizer selected. Moreover, there continues to be a need for generating positively charged or negatively charged colored toner compositions which can be prepared in a simple and economical manner; and wherein the resulting charge enhancing additive moiety is retained and not leeched from the toner as is the situation with several prior art charge enhancing additives. Additionally, there continues to be a need for generating color toner compositions of an appropriate size diameter of from 5 to 20 microns; and wherein the charge enhancing additive function is assumed by the stabilizer compounds selected for the dispersion polymerization process. There is also a need for dispersion polymerization processes wherein the resulting color toner compositions are of monodispersed particle size distributions; and wherein the colorant selected is molecularly dissolved within the toner particles with exceptionally high desirable homogeneity. Further, there is a need for obtaining colored toner compositions by dispersion polymerization processes wherein the charge directing compound, that is the stabilizer, is chemically and permanently anchored on the surface of the toner particles. Also, there is a need for obtaining colored xerographic toners by dispersion polymerization processes enabling the compositions resulting to possess a lower fusing temperature.

SUMMARY OF THE INVENTION

It is an object of the present invention to provide processes for colored toner compositions which overcome several of the above-noted disadvantages.

A further object of the present invention resides in the provision of dispersion polymerization processes wherein there results positively charged or negatively charged colored toner particles.

In an additional object of the present invention there are provided dispersion polymerization processes wherein the stabilizers selected are chemically attached to the toner polymer permitting them to function as charge enhancing additives.

In yet a further object of the present invention there are provided dispersion polymerization processes for generating colored toner compositions wherein the stabilizer selected is chemically and permanently anchored to the surface of the toner particles.

In a further object of the present invention there are provided dispersion polymerization processes wherein the stabilizers selected are chemically transformed causing the surface thereof to function as charge enhancing additive sites.

A further object of the present invention resides in the provision of dispersion polymerization processes for obtaining colored toner compositions wherein the stabilizers selected can be optionally chemically transformed by alkyl halides, carboxylic acids, and aliphatic alcohols, permitting the surface thereof to function as charge enhancing additive sites.

In yet a further object of the present invention there are provided processes for obtaining colored xerographic toners wherein the colorant is molecularly dispersed within the toner particles with exceptionally high homogeneity.

In yet a further object of the present invention there are provided dispersion polymerization processes for obtaining colored toners with low fusing temperatures, that is, from about 80° C. to about 120° C. in some instances.

In yet another object of the present invention there is provided dispersion polymerization processes for obtaining colored dry toner compositions which can be selected for use in developing images in the electrostatographic processes with positively charged or negatively charged imaging members.

A further object of the present invention resides in the preparation of colored dry toner compositions possessing narrow size distributions and a diameter of from about 5 microns to about 20 microns.

These and other objects of the present invention are accomplished by the provision of dispersion polymerization processes wherein the stabilizers selected are chemically and permanently attached to the toner polymer. More specifically, in one embodiment there is provided in accordance with the present invention a dispersion polymerization process which comprises affecting polymerization of a monomer, or a mixture of monomers in the presence of a steric stabilizer, subsequently diffusing a dye solution therein, and thereafter subjecting the resulting mixture to further processing, inclusive of freeze drying, for the purpose of isolating dry colored xerographic toner compositions.

In one specific important embodiment of the present invention there is provided dispersion polymerization processes which comprise providing a solvent medium having dissolved therein a monomer, adding to the monomer solution a steric stabilizer selected from the group consisting of hydroxy celluloses, poly(acrylic acids), poly(vinylpyrrolidone), poly(vinylpyridines), poly(ethylene oxides), poly(styrene sulfonic acids) and poly(maleic anhydride copolymers), affecting polymerization of the monomer enabling the formation of monodispersed particles, and permitting permanent attachment of the stabilizer in an amount of less than 1 percent by weight, for example, to the polymer particles generated optionally subsequently transforming the surface of the stabilizer by the reaction with compositions selected from a group consisting of alkyl halides, carboxylic acids, and aliphatic alcohols; introducing into the aforementioned dispersion a dye solution having incorporated therein various known dyes inclusive of red, blue, yellow, cyan, magenta, black, or mixtures thereof; and subsequently subjecting the resulting mixture of solvent medium and colored polymer particles to further processing inclusive of spray drying or freeze drying permitting dry colored xerographic toners that are positively or negatively charged depending on the stabilizer selected.

The steric stabilizer is present on the surface of the polymer particles, and is permanently anchored thereto. While it is not desired to be limited by theory, it is believed that the steric stabilizer is situated on the surface of the polymer particles in view of its amphipathic characteristics. Blocks or segments of a grafted side chain of the stabilizer, which are not soluble in the solvent medium and are identical to the polymerized monomer become embedded in the polymer thereby acting as an anchor whereas segments of grafted stabilizers which are soluble in the solvent coat the surface of the polymer particles prior to the isolation step.

Illustrative examples of monomers selected for the process of the present invention include, for example, various suitable vinyl monomers such as styrene, p-chlorostyrene, vinylnaphthalene, and the like; vinyl halides such as vinylchloride, vinylbromide, vinylacetate, vinyl esters inclusive of monocarboxylic acids, such as methylacrylate, ethylacrylate, and butylacrylate, dodecylacrylate, phenylacrylate, methylmethacrylate, ethylmethacrylate, butylmethacrylate, and other similar monomers; monomer mixtures; diolefins, inclusive of styrene butadienes; and vinyl siloxane monomers.

Various known steric stabilizers can be selected for the dispersion process of the present invention inclusive of cellulose derivatives, poly(acrylates), poly(methacrylates), poly(vinyl acetal), poly(ethers), poly(vinyl ethers), poly(vinyl amines), and poly(vinyl amides). Specific examples of stabilizers include hydroxy ethyl cellulose, hydroxy propyl cellulose, ethyl cellulose, and cellulose propionate; poly(acrylic acid), poly(hydroxy ethyl acrylate), poly(methoxy polyethylene glycol acrylate), poly(methacrylic acid), poly(hydroxy ethyl methacrylate), poly(methoxy polyethylene glycol methacrylate), poly(vinyl butyrals), poly(ethylene glycol), poly(ethylene oxide), poly(propylene oxide), poly(methyl vinyl ether), poly(2-vinyl pyridine), poly(4-vinyl pyridine), poly(vinyl pyrolidone), copolymers thereof; and copolymers of maleic acid and maleic anhydride. Accordingly, for example, strongly positively charged colored toners can be obtained when poly(vinylpyridine), poly(ethylene oxide), and cellulosic derivatives are selected as steric stabilizers, while negatively charged colored toners are generated when poly(acrylic acid), poly(styrene sulfonic acid), and poly(maleic anhydride copolymers are used as stabilizers.

Specific examples of transforming compounds that can be selected for the optional process embodiment of the present invention include ethyl bromide, propyl bromide, cetyl bromide, cetyl chloride, cetyl iodide and the like; acetic acid, acetic anhydride, benzoic acid, and similar acids; ethanol, propanol, butanol, dodecanol, and the like. Transforming compounds are incorporated in amounts of from 0.1 percent to 1.0 percent by weight based on the weight of the monomer, or comonomer particles to be converted. The transformation process can be performed in a separate step, or can be affected in the solvent mixture immediately prior to the monomer polymerization. Also, the stabilizer can be prepared from its monomer in the solvent medium immediately prior to the resin monomer polymerization.

The aforementioned mixture comprised of monomer or comonomer dispersed in an aqueous medium, which solution has present therein the steric stabilizers illustrated, can be polymerized at a temperature of from about 55° C. to about 85° C. resulting in polymer particles of a size of from about 5 microns to about 20 microns; and wherein the steric stabilizer is permanently attached to the surface of the polymer particles. Thereafter, there is diffused into the resulting mixture a dye solution comprised of an organic solvent and various known dyes inclusive of red, blue, yellow, cyan, magenta, or mixtures thereof. Specific examples of dyes selected are Oil Blue A, Passaic Oil Green, Sudan Red, Sudan Yellow 146, DuPont Oil Blue A, Passaic Oil Red 2144, Oil Yellow, Sudan Red 7B, Oil Pink 312, Pylachrome Pink LX1900, Sudan Black B, Ceres Blue R, Sudan Deep Black, Ceres Black BN, a dye mixture containing the cyan Savinyl Blue GLS, the magenta Sudan Red 460, and the yellow dye Sudan Yellow 146. The dye is present in the organic solvent in an amount of from about 1 percent by weight to about 50 percent by weight; and preferably in an amount of from about 15 percent by weight to about 25 percent by weight.

Examples of organic solvents that can be selected for the process of the present invention include methylene chloride, toluene, cyclohexane, butylacetate, and the like, with methylene chloride being preferred. Generally, from about 1 milliliter to about 50 milliliters, and preferably from about 5 milliliters to about 15 milliliters of solvent are selected for each gram of dye to be dissolved therein. Dissolving of the dye is accomplished by simple stirring of the organic mixture comprised of solvent and dye. Subsequent to the evaporation of the solvent from the reaction mixture, the dye is retained in the polymer particles.

The dye solution can be added to the polymerized particles in various suitable amounts providing the objectives of the present invention are achieved, however, the dye solution is added in an amount of from about 10 percent to about 500 percent by weight of the polymer particles. Upon the addition of the dye solution to the polymerized mixture an entropic dilution effect due to the initial absence of dye in the particles and the high polymer concentration causes the dye to diffuse through the solvent medium and into the polymer particles. The effectiveness and completion of this diffusion process is dependent on a number of factors including the concentration of the dye, solvent, and polymer particles, the specific types of dyes used, the nature of the particles being treated, and the temperature at which the process is accomplished.

For obtaining toner particles, the mixture of dyed particles, and solvent medium resulting subsequent to diffusion of the dye solution is subjected to further processing, inclusive of known spray drying or freeze drying methods permitting toner particles with the size diameter of from about 5 to about 20 microns. In one embodiment, the spray drying is affected by forming a suspension of dye particles and solvent medium which are continuously stirred to prevent settling and removed by means of a peristaltic pump to the spray dryer inlet nozzle. The atomized suspension can then be dried at 120° C. in a drying chamber and collected in a product cyclone. Toner particles isolated in this matter can then be selected immediately for the purpose of developing latent electrostatic images present, for example, on a photoconductive imaging member.

There is thus obtained with the process of the present invention positively charged toner compositions with a triboelectric charging value of from about +5 microcoulombs per grams to about +50 microcoulombs per gram; and preferably from about +15 microcoulombs per gram to about +30 microcoulombs per gram. Similarly, negatively charged colored toner particles can be obtained with a triboelectric charging value of from about −5 microcoulombs per gram to about −50 microcoulombs per gram; and preferably from about −15 microcoulombs per gram to about −30 microcoulombs per gram.

Illustrative examples of carrier particles that can be selected for mixing with the toner particles resulting from the process of the present invention include those that are capable of triboelectrically obtaining a charge of opposite polarity to that of the toner particles. Accordingly, the carrier particles for the developer composition are selected so as to be of a negative polarity permitting the toner particles which are positively charged to adhere to and surround the carrier particles; or of a positive polarity enabling toner particles which are negatively charged. Illustrative examples of carrier cores include methylmethacrylates, glass, steel, nickel, iron, ferrites, and the like, encased in a polymeric coating, inclusive of fluoropolymers, terpolymers, particularly terpolymers of styrene, methylmethacrylate, and vinyl triethoxy silane, and other similar substances.

The diameter of the carrier particles can vary, generally however, this diameter is from about 50 microns to about 1,000 microns allowing the resulting particles to possess sufficient density and inertia to avoid adherence to the electrostatic images during development process. Carrier particles can be mixed with toner particles in various suitable combinations. However, best results are obtained when from about 1 part per toner to about 10 parts to about 200 parts by weight of carrier are admixed.

The toner and developer compositions of the present invention may be selected for use in developing colored images in electrostatographic imaging processes containing therein inorganic photoreceptors, organic photo-receptors, and layered photoreceptor members which are generally positively charged. Inorganic imaging members that may be selected include selenium, selenium alloys, such as selenium arsenic, selenium tellurium, and the like; cadmium sulfide; halogen doped selenium substances; and halogen doped selenium alloys. Organic members include pyrillium dyes, polyvinylcarbazoles, and similar compounds; while illustrative examples of layered photoresponsive imaging members are comprised of transport layers and photogenerating layers, reference U.S. Pat. No. 4,265,990, the disclosure of which is totally incorporated herein by reference. Examples of generating layers selected for these members are trigonal selenium, metal phthalocyanines, metal-free phthalocyanines, and vanadyl phthalocyanines; while examples of charge transport layers include those aryl amines as described in the U.S. Pat. No. '990 patent.

The following examples are being supplied to further define various species of the present invention, and it being noted that these examples are intended to illustrate and not limit the scope of the present invention. Parts and percentages are by weight unless otherwise indicated.

EXAMPLE I

There were prepared polystyrene particles by first dissolving with stirring 3.8 grams of the stabilizer poly(acrylic acid) in 125 milliliters of methyl cellosolve, and 87.5 milliliters of ethanol at 68° C. Subsequent to the stabilizer being dissolved there were added 38 milliliters of styrene and 1.5 grams of benzoylperoxide. Within 10 minutes, while maintaining the temperature at 68° C., the reaction mixture became cloudy, indicating the initiation of polymerization, and after 48 hours, there resulted prior to separation a product consisting of monodispersed polystyrene particles with a diameter of 5.6 microns and a geometric standard deviation of 1.19 with the steric stabilizer permanently attached thereto.

These product particles were then isolated from the solvent medium by centrifugation. Subsequently, the particles were redispersed in water. This procedure was repeated twice, followed by isolating the polymer particles from the water phase by freeze drying. Excess poly(acrylic acid) steric stabilizer was removed during the washing process, however, its presence on the polymer particles could be detected with triboelectric charge measurements, −25 microcoulombs per gram, with the known Faraday cage process, indicating that the permanently attached stabilizer was located on the surface of the polymer particles. Titration of the surface of the particles with sodium hydroxide showed that less than 1 weight percent of the particles were stabilized.

Thereafter, the resulting polymer particles were dispersed in a 0.25 percent by weight aqueous sodium dodecyl sulfate solution containing 5 to 30 percent by weight of acetone. Dispersion was affected by placing into the sodium dodecyl sulfate solution the stabilized polymer particles followed by sonication for one minute. No breakage of particles was observed, however, this treatment was sufficient to disperse any agglomerates of polymer particles.

A dye solution consisting of 1 percent by weight of Passaic Oil Red 2144 dissolved in 50 milliliters of methylene chloride was then added to 100 milliliters of a 0.25 percent aqueous sodium dodecyl sulfate. This mixture was sonified for 5 minutes resulting in a homogeneous emulsion. The emulsion was then added to the above polymer particle dispersion, and after stirring for 12 hours the particles were allowed to settle and the solvent medium was removed. The dye polymer particles were dispersed with stirring in 200 milliliters of a second sodium dodecyl sulfate solution, 0.25 percent. Methylene chloride was then removed from the resulting particles by blowing air over the stirred dispersion. Thereafter, in order to generate a colored toner composition, red in color, the particles obtained after removal of the methylene chloride were then freeze dried by centrifugation of the particulate dispersion and redispersion in deionized water. This procedure was repeated twice, and the redispersed suspension was then frozen. A 100 millitorr vacuum was applied to the frozen mixture, the water removed, and there resulted a toner composition red in color, containing polystyrene, about 97 percent by weight, 2 percent by weight of red dye, and less than 1 percent by weight of poly(acrylic acid) stabilizer permanently attached to the polystyrene, with a size diameter of 5.6 microns, a geometric standard deviation of 1.19, and a triboelectric charge thereon of about −25 microcoulombs per gram.

The above prepared toner composition was then incorporated into a xerographic imaging test fixture with a positively charged selenium photo-receptor. There resulted subsequent to the formation of electrostatic images development followed by transfer to paper, and affixing thereon by fusing images red in color, of excellent resolution, with substantially no background obtained until the toner supply was exhausted.

EXAMPLE II

To a 12 liter reaction vessel, fitted with a temperature controller, temperature recorder, mechanical stirrer, water cooled condenser, nitrogen inlet, for maintaining a nitrogen atmosphere and a heating mantle, there was added a mixture of 1.2 liters of denatured ethanol and 3.0 liters of methylcellosolve. The reaction vessel was purged with nitrogen for 10 minutes. Ninety grams of polyacrylic acid of a molecular weight of 250,000, Polysciences, was then added to the reaction mixture, followed by slowly heating to 68° C. Thereafter, benzoyl peroxide, 36 grams, 0.149 mole, was dissolved in styrene, 900 milliliters, 7.85 mole. When the dissolution was complete, the styrene solution was added to the reaction vessel with constant stirring, and the resulting mixture became cloudy in 5 minutes indicating the initiation of polymerization. The reaction mixture was then stirred at 68° C. for 42 hours completing polymerization of the styrene monomer, then cooled slowly with stirring to 30° C. in 6 hours. Stirring was stopped, the polystyrene particles were allowed to settle for 16 hours, the supernatant was pumped out of the reaction vessel and the supernatant was replaced with 3 liters of methanol. The resulting suspension was stirred for 3 hours, and the particles were allowed to settle. The methanol was removed and the washing process was repeated using methanol. The particles resulting were then washed 3 times with 4 liters of 0.25 percent sodium dodecyl sulfate (SDS) solution, and finally resuspended in 2 liters of the SDS solution. Acetone, 60 milliliters, was slowly added to the stirring suspension. There resulted polymerized polystyrene particles with the polyacrylic stabilizer permanently attached thereto.

Passaic Oil Red A dye, 4.8 grams, was dissolved in 720 milliliters of methylene chloride, then filtered through 2 layers of #4 Whatman filter paper. This dye solution was then divided into 12 portions. Each portion was mixed with 200 milliliters of the SDS solution, and sonified for 5 minutes. The 12 dye emulsions were separately added to the above prepared polystyrene particle suspension and stirred for 16 hours. Stirring was discontinued and the dyed particles were allowed to settle. The supernatant was pumped out and the particles were washed twice with 3 liters of the SDS solution. Thereafter, the dyed particles were resuspended in 3 liters of SDS, and air was passed over the stirring mixture for 16 hours to remove any residual methylene chloride. Finally, the particles were washed twice with 4 liters of water and freeze dried by repeating the procedure of Example I, yielding 657 grams of red monodispersed polystyrene toner particles with a diameter of 12 microns, (GSD=1.14), and with a dye content of 0.7 percent, a triboelectric charge thereof of about −20 microcoulombs per gram, and less than 1 percent by weight of stabilizer attached thereto.

This toner composition was then incorporated into the xerographic imaging test fixture of Example I, and there resulted red images of excellent resolution until the toner was exhausted.

EXAMPLE III

Denatured ethanol, 600 milliliters, and water, 48 milliliters, were placed in a 1-liter 3-necked round bottom flask fitted with a mechanical stirrer, thermometer, water cooled condenser and a gas inlet. Polyacrylic acid, 10.5 grams of a molecular weight of 250,000 available from Scientific Polymer Products, was added to the ethanol/water mixture; and the flask was purged with nitrogen. The polyacrylic acid solution was then slowly heated to 68° C.

Benzoyl peroxide 4.5 grams, 0.0185 mole, was dissolved in a 60/40 mixture of styrene/n-butylmethacrylate copolymer, 120 milliliters. Thereafter, this monomer solution was added to the reaction flask wherein the mixture became cloudy within 5 minutes. Subsequently, the reaction mixture was stirred at 68° C. for 16 hours, then was allowed to cool to room temperature with stirring. The copolymer particles, resulting less than 20 microns in diameter, were centrifuged and resuspended in a 50:50 methanol/water, 500 milliliters. The suspension was stirred for 3 hours followed by washing, once with the methanol/water mixture and twice with water. Freeze drying in accordance with the process of Example I yielded 87 grams of copolymer particles. Twelve grams of the particles were then suspended in a 0.25 percent SDS solution, 125 millliters. Subsequently, 0.30 grams of Sudan Yellow 150 was dissolved in methylene chloride, 10 milliliters, and filtered through glass wool into a second 0.25 percent SDS solution, 50 milliliters. The aforementioned mixture was sonified for 4 minutes producing a dye emulsion. Thereafter, 25 milliliters of the 12 gram copolymer particle suspension was poured into a 125 milliliter Ehrlenmeyer flask and acetone, 1 milliliter, was added to the mixture with stirring. The dye emulsion was then added to the stirred copolymer particle suspension and stirring was continued for 16 hours. The dyed particles were centrifuged then washed 3 times with SDS solution. The yellow particles were then resuspended in 100 milliliters of SDS solution and stirred under a partial vacuum, pressure of about 30 torr, for 16 hours to remove any residual methylene chloride still present in the particles. Finally, the dyed toner particle, consisting of about 97 percent by weight of copolymer, less than 1 percent by weight of the stabilizer permanently attached to the copolymer, and about 2 percent by weight of yellow dye were washed twice with water and freeze dried yielding 1.90 grams of bright yellow toner particles. This yellow toner was found to have a negative tribocharge of about −20 microboulombs per gram, and a diameter of between 10 and 20 microns.

EXAMPLE IV

To a 2 liter round bottom flask were added 1.2 liters denatured ethanol, and 105 grams deionized water. After heating to 68° C., 20 grams of the steric stabilizer poly(vinyl pyrrolidone-co-vinyl acetate) were added to the stirred mixture. The steric stabilizer solution was stirred under nitrogen atmosphere for one hour, and then a solution composed of 9.0 grams of benzoyl peroxide, 144 milliliters of styrene monomer, and 96 milliliters of n-butylmethacrylate monomer was added thereto. The resulting reaction mixture appeared cloudy after less than 5 minutes, and became increasingly milky in appearance during the 15 hours it was maintained at 68° C., indicating polymerization. The temperature was then raised to 75° C. for 5 hours to complete the polymerization.

After cooling to room temperature, the copolymer particles were of styrene n-butyl methacrylate centrifuged followed by decanting the supernatant. The copolymer particles were then redispersed in one liter of a 0.25 percent sodium dodecyl sulfate solution in the presence of 30 milliliters of acetone. To this mixture was added an emulsion consisting of an organic phase of 200 milliliters of methylene chloride and 10 grams of Sudan Red 7B dye dispersed in 500 milliliters of a second 0.25 percent aqueous sodium dodecyl sulfate. The suspension was stirred for several hours until the swollen particles were colored, as determined by an optical microscope, followed by centrifugation. The supernatant was then decanted, and the dye copolymer particles redispersed in 1 liter of water. Methylene chloride was permitted to evaporate completely from the particles, and after centrifugation of the particles, and their redispersion in 1 liter of water, the dye copolymer particles were freeze dried. The toner obtained contained 96 percent by weight of copolymer, 2.8 percent by weight of red dye, and less than 1 percent by weight of stabilizer permanently attached thereto. These toner particles, magenta in color, resulting were 6.6 microns in diameter, (GSD=1.15), and had a triboelectric charge of +20 microcoulombs per gram.

EXAMPLE V

The procedure for the preparation of polymer particles was accomplished by repeating the procedure of Example IV. These particles were then dyed as follows. The polymer particles were centrifuged and redispersed in 300 milliliters of denatured ethanol. To this suspension was added a solution composed of 4 grams of Passaic Oil Red 2144, 150 milliliters of toluene and 150 milliliters of ethanol. Water was then added dropwise into this stirred mixture until color was observed in the concentrated swollen particles under an optical microscope. The toluene was then distilled out of the mixture with rotary evaporation, .and the resulting particles were centrifuged, the supernatant decanted, and then redispersed in 300 milliliters deionized water. A fraction of the resulting red product was freeze dried to produce a red toner. The remaining fraction was spray dried resulting in a second red toner. These toners had a triboelectric charge of +20 microcoulombs per gram, and a diameter of about 5 microns to about 15 microns.

Other modifications of the present invention may occur to those skilled in the art based upon reading of the present disclosure, and these modifications are intended to be included within the scope of the present invention.

What is claimed is:

1. An improved process for obtaining positively charged or negatively charged colored toner compositions of a particle diameter of from about 5 to about 20 microns by dispersion polymerization which comprises providing a monomer or comonomer solution with stabilizer therein, polymerizing the resulting mixture, adding thereto a dye solution comprised of an organic solvent having dissolved therein oil soluble dyes, causing the dye solution to diffuse into the polymer particles, wherein the stabilizer is chemically and permanently attached to the toner polymer particles.

2. A process in accordance with claim 1 wherein the monomer is styrene.

3. A process in accordance with claim 1 wherein the comonomer solution is styrene and n-butyl methacrylate.

4. A process in accordance with claim 1 wherein the comonomer solution is styrene and butadiene.

5. A process in accordance with claim 1 wherein the stabilizer is selected from the group consisting of poly(acrylic acid), poly(ethylene oxide), poly(vinyl pyridine), poly(vinyl pyrrolidone), and copolymers containing these segments, and copolymers of maleic anhydride and maleic acid.

6. A process in accordance with claim 1 wherein the polymerization reaction is affected at a temperature of about 50° C. to about 100° C.

7. A process in accordance with claim 1 wherein the dye solution is comprised of red dyes, blue dyes, cyan dyes, magenta dyes, yellow dyes, black dyes or mixtures thereof.

8. A process in accordance with claim 1 wherein the organic solvent for the dye solution is methylene chloride.

9. A process in accordance with claim 1 wherein the organic solvent is toluene.

10. A process in accordance with claim 1 wherein the dye solution comprises from about 1 percent to about 50 percent of oil soluble dye.

11. A process in accordance with claim 1 wherein there results positively charged toner compositions with steric stabilizers selected from a group consisting or polyvinyl pyridine, polyethylene oxide, hydroxy alkoxyl cellulose, polyvinyl pyrrolidone, and copolymers with these segments.

12. A process in accordance with claim 1 wherein there results negatively charged toner particles with stabilizers of poly(acrylic acid), copolymers thereof, or copolymers of maleic acid or maleic anhydride.

13. A process in accordance with claim 11 wherein the triboelectric charging value on the toner compositions is from about +15 microcoulombs per gram to about +50 microcoulombs per gram.

14. A process in accordance with claim 12 wherein the triboelectric negative charge on the resulting toner particles is from about −15 microcoulombs per gram to about −50 microcoulombs per gram.

15. A process in accordance with claim 1 wherein the toner particles are separated by freeze drying.

16. A process in accordance with claim 1 wherein the toner particles are separated by spray drying.

17. A process in accordance with claim 1 wherein the toner particles are of a GSD of less than 1.2.

18. An improved process for obtaining positively charged or negatively charged colored toner compositions of a particle diameter of from about 5 to about 20 microns by dispersion polymerization consisting essentially of providing a monomer or comonomer solution with a stabilizer therein, polymerizing the resulting mixture, adding thereto a dye solution comprised of an organic solvent having dissolved therein an oil soluble dye; causing the dye solution to diffuse into the polymer particles; and subsequently separating the resulting toner particles wherin the stabilizer is chemically and permanently attached to the toner polymer particles.

19. A process in accordance with claim 18 wherein there results positively charged toner compositions with steric stabilizers selected from the group consisting of polyvinyl, pyridine, polyethylene oxide, hydroxy alkoxyl cellulose, polyvinyl pyrrolidone, and copolymers with these segments.

20. A process in accordance with claim 18 wherein there results negatively charged toner particles with stabilizers selected from the group consisting of poly(acrylic acid), copolymers thereof, and copolymers of maleic acid, and copolymers of maleic anhydride.

21. An improved process for obtaining positively charged colored toner compositions with a particle diameter of from about 5 to about 20 microns by dispersion polymerization consisting essentially of providing a monomer or copolymer solution with a stabilizer selected from the group consisting of polyvinyl, pyridine, polyethylene oxide, hydroxy alkoxyl cellulose, and polyvinyl pyrrolidone; polymerizing the resulting mixture; adding thereto a dye solution comprised of an organic solvent having dissolved therein an oil soluble dye; causing the the dye solution to diffuse into the polymer particles; and subsequently separating the resulting toner particles wherein the stabilizer is chemically and permanently attached to the toner polymer particles.

22. An improved process for obtaining negatively charged colored toner compositions with a particle diameter of from about 5 to about 20 microns by dispersion polymerization consisting essentially of providing a monomer or copolymer solution with a stabilizer therein selected from the group consisting of poly(acrylic acid), copolymers thereof, or copolymers of maleic acid; polymerizing the resulting mixture; adding thereto a dye solution comprised of an organic solvent having dissolved therein an oil soluble dye; causing the dye solution to diffuse into the polymer particles; and subsequently separating the resulting toner particles wherein the stabilizer is chemically and permanently attached to the toner polymer particles.

* * * * *